United States Patent [19]

Allen et al.

[11] Patent Number: 5,034,295

[45] Date of Patent: Jul. 23, 1991

[54] FLEXIBLE ELECTROSTATOGRAPHIC IMAGING SYSTEM

[75] Inventors: Mercedes Allen, Webster; Susan Robinette, Pittsford; Anita P. Lynch, Webster, all of N.Y.

[73] Assignee: Xerox Corporation, Stamford, Conn.

[21] Appl. No.: 459,408

[22] Filed: Dec. 29, 1989

[51] Int. Cl.[5] ..... G03G 5/14

[52] U.S. Cl. ..... 430/58; 355/212; 430/96; 430/84

[58] Field of Search ..... 430/96, 84, 58

[56] References Cited

U.S. PATENT DOCUMENTS

| | | | |
|---|---|---|---|
| 3,816,118 | 6/1974 | Byrne | 96/1.5 |
| 3,879,199 | 4/1975 | Trubisky | 96/1.5 |
| 3,948,657 | 4/1976 | Yoshikawa et al. | 96/1.5 |
| 4,175,957 | 11/1979 | Karam | 430/84 X |
| 4,265,990 | 5/1981 | Stolka et al. | 430/59 |
| 4,340,658 | 7/1982 | Inoue et al. | 430/58 |
| 4,439,507 | 3/1984 | Pan et al. | 430/59 |
| 4,464,450 | 8/1984 | Tauscher | 430/59 |
| 4,701,396 | 10/1987 | Hung et al. | 430/58 |
| 4,786,570 | 11/1988 | Yu et al. | 430/58 |

*Primary Examiner*—David Welsh

[57] ABSTRACT

A flexible electrophotographic imaging member including a supporting substrate, a charge generation layer and a charge transport layer, the charge generation layer containing a homogeneous dispersion of photoconductive particles of trigonal selenium dispersed in a film forming polymer blend of polycarbonate, polyvinylchloride-polyvinylacetate copolymer and a polymeer selected from the group consisting of phenoxy resin, styrene butadiene copolymer and mixtures thereof. This imaging member may be employed in an electrophotographic imaging process.

18 Claims, No Drawings

FLEXIBLE ELECTROSTATOGRAPHIC IMAGING SYSTEM

BACKGROUND OF THE INVENTION

This invention relates in general to electrostatography and, more specifically, to a flexible electrophotoconductive imaging member having an improved charge generation layer and process for using the member.

In the art of xerography, a xerographic plate comprising a photoconductive insulating layer is imaged by first uniformly depositing an electrostatic charge on the imaging surface of the xerographic plate and then exposing the plate to a pattern of activating electromagnetic radiation such as light which selectively dissipates the charge in the illuminated areas of the plate while leaving behind an electrostatic latent image in the nonilluminated areas. This electrostatic latent image may then be developed to form a visible image by depositing finely divided electroscopic marking particles on the imaging surface.

A photoconductive layer for use in xerography may be a homogeneous layer of a single material such as vitreous selenium or it may be a composite layer containing a photoconductor and another material. One type of composite photoconductive layer used in electrophotography is illustrated in U.S. Pat. No. 4,265,990. A photosensitive member is described in this patent having at least two electrically operative layers. One layer comprises a photoconductive layer which is capable of photogenerating holes and injecting the photogenerated holes into a contiguous charge transport layer. Generally, where the two electrically operative layers are positioned on an electrically conductive layer with the photoconductive layer sandwiched between a contiguous charge transport layer and the conductive layer, the outer surface of the charge transport layer is normally charged with a uniform electrostatic charge and the conductive layer is utilized as an electrode. In flexible electrophotographic imaging members, the electrode is normally a thin conductive coating supported on a thermoplastic web. Obviously, the conductive layer may also function as an electrode when the charge transport layer is sandwiched between the conductive layer and a photoconductive layer which is capable of photogenerating electrons and injecting the photogenerated electrons into the charge transport layer. The charge transport layer in this embodiment, of course, must be capable of supporting the injection of photogenerated electrons from the photoconductive layer and transporting the electrons through the charge transport layer.

Various combinations of materials for charge generating layers and charge transport layers have been investigated. For example, the photosensitive member described in U.S. Pat. No. 4,265,990 utilizes a charge generating layer in contiguous contact with a charge transport layer comprising a polycarbonate resin and one or more of certain aromatic amine compounds. Various generating layers comprising photoconductive layers exhibiting the capability of photogeneration of holes and injection of the holes into a charge transport layer have also been investigated. Typical photoconductive materials utilized in the generating layer include amorphous selenium, trigonal selenium, and selenium alloys such as selenium-tellurium, selenium-tellurium-arsenic, selenium-arsenic, and mixtures thereof. The charge generation layer may comprise a homogeneous photoconductive material or particulate photoconductive material dispersed in a binder. Other examples of homogeneous and binder charge generation layer are disclosed in U.S. Pat. No. 4,265,990. Additional examples of binder materials such as poly(hydroxyether) resins are taught in U.S. Pat. No. 4,439,507. The disclosures of the aforesaid U.S. Pat. No. 4,265,990 and U.S. Pat. No. 4,439,507 are incorporated herein in their entirety. Photosensitive members having at least two electrically operative layers as disclosed above in, for example, U.S. Pat. No. 4,265,990 provide excellent images when charged with a uniform negative electrostatic charge, exposed to a light image and thereafter developed with finely developed electroscopic marking particles.

Photoconductive particles dispersed in a film forming binder matrix are commonly employed in charge generating layers of photosensitive members having at least two electrically operative layers. A charge generation layer containing photoconductive particles such as trigonal selenium particles dispersed in a binder matrix such as polyvinylcarbazole exhibits excellent photoresponse properties. In the form of belts having welded seams, such photoreceptors perform very well in conventional copiers and duplicators which utilize relatively large diameter photoreceptor belt drive and support rollers and gentle cleaning systems. Although trigonal selenium particles have excellent sensitivity and good response to visible light, the particles are especially difficult to disperse in polymer binders. More specifically, when photoconductive trigonal selenium particles are dispersed a film forming binder, difficulties can be encountered in achieving a uniform dispersion of the particles in the binder matrix. Nonuniform dispersion of photoconductive particles in the binder adversely affects the uniformity of electrical response over different regions of the photoreceptor.

For flexible photoreceptors, many film forming binders such as polyvinylcarbazole tend to be brittle and can crack or delaminate during extended cycling or even during cutting of photoreceptor sheets from a photoreceptor web. Small diameter drive or support rollers (e.g. 19 mm or smaller) for belt type photoreceptors are desirable for effective automatic paper stripping. However, photoreceptor belts formed by welding overlapping opposite ends of a cut photoreceptor sheet tend to prematurely fail at the seam when cycled around these small diameter drive or support rollers particularly in embodiments where the charge generating layer does not adhere well to adjacent layers. Thus, for example, photoreceptors containing a charge generation layer comprising trigonal selenium particles dispersed in polyvinylcarbazole usually utilize an adhesive layer to improve the adhesion of the charge generation layer to the underlying charge blocking layer or conductive layer.

Thus, the characteristics of electrostatographic imaging members comprising charge generation layers comprising photoconductive particles dispersed in a binder exhibit many deficiencies in automatic, cyclic electrostatographic copiers, duplicators, and printers, particularly with respect to mechanical properties.

INFORMATION DISCLOSURE STATEMENT

U.S. Pat. No. 4,786,570 to Yu et al, issued Nov. 22, 1988—A flexible photoreceptor is disclosed containing certain specific blocking and adhesive layer materials. Also disclosed, for example, in column 15, line 16, are generator layers that can contain a trigonal selenium photoconductive material. In column 15, lines 24–45 binders such as polycarbonate, polyvinylchloride, vinylchloride and vinylacetate copolymer, styrene butadiene copolymer and the like are disclosed.

U.S. Pat. No. 3,816,118 to Byrne, issued Jun. 11, 1974—An electrophotographic plate containing phthalocyanine pigment dispersed in a binder is disclosed. Various binders are disclosed, for example in column 6, lines 6–18 such as polyvinylchloride, polyvinylacetate, polystyrene-polybutadiene copolymer, and phenoxy.

U.S. Pat. No. 4,340,658 to Inoue et al, issued Jul. 20, 1982—A laminated photosensitive material for electrophotography is disclosed wherein, for example, zinc oxide is dispersed in a resin binder, e.g. see column 3, lines 6–15. Binders applicable for the photosensitive material include copolymers of vinylchloride/vinylacetate, polycarbonates, or styrene/butadiene copolymers. The binders may be used singly or in the form of a mixture of two or more of them, e.g. see column 3, line 58–column 4, line 18.

U.S. Pat. No. 3,948,657 to Yoshikawa et al, issued Apr. 6, 1976—A electrophotographic photosensitive member is disclosed comprising a photoconductive layer on a base and a polymeric solventless-type liquid resin adhesive placed between the photoconductive layer and an overlying insulating layer. Fine grains of photoconductive material may be dispersed in the adhesive to provide a second photoconductive layer. The solventless polymeric adhesives used may include polyvinyl acetate and vinylchloride-vinylacetate copolymer resin, e.g. see column 3, line 64–column 4, line 11. The photoconductive grains may comprise selenium, e.g. see column 8, lines 17–35.

U.S. Pat. No. 4,701,396 to Hung et al, issued Oct. 20, 1987—A photoconductive element containing dispersion coated flourine-substituted titanylphthalocyanine is disclosed. Various binders such as styrene butadiene copolymer and polycarbonate are disclosed, for example, in column 13, lines 36–56.

U.S. Pat. No. 3,879,199 to Trubisky, issued Apr. 22, 1975—An arsenic-selenium photoconductive layer is disclosed which comprises a coating of an organic material which may include a mixture of vinylchloride and vinylacetate, mesitylene and phenoxy resins, e.g. see column 2, lines 27–39.

U.S. Pat. No. 4,464,450 to Teuscher, issued Aug. 7, 1984—A photosensitive member is disclosed having a metal oxide layer, a siloxane layer, charge generating layer and a charge transport layer. The siloxane is a reaction product of certain hydrolyzed amino silanes. A phenoxy resin may be utilized as a binder for photogenerating pigments in the charge transport layer.

U.S. Pat. No. 4,439,507 to Pan et al, issued Mar. 27, 1984—A photosensitive member is disclosed having a conductive layer, a photogenerating layer comprised of photoconductive material dispersed in a poly(hydroxyether) (phenoxy) material and a charge transport layer containing a binder and certain aromatic diamines.

U.S. Pat. No. 4,265,990 to Stolka et al, issued May 5, 1981—A photosensitive member is disclosed having a photoconductive layer and a charge transport layer containing a polycarbonate resin and certain aromatic diamines. The photoconductive layer may comprise photoconductive particles dispersed in an insulating resin, e.g. see column 11, lines 25–43.

SUMMARY OF THE INVENTION

It is an object of the invention to provide an electrophotographic imaging member which overcomes the above-noted disadvantages.

It is an another object of this invention to provide a thin, flexible electrophotographic imaging member with improved resistance to delamination.

It is still another object of this invention to provide a thin, flexible electrophotographic imaging member having charge generation layers in which photoconductive particles are more uniformly dispersed in a binder and exhibit uniform electrical properties.

It is another object of this invention to provide a thin, flexible electrophotographic imaging member which exhibits improved resistance to failure of welded seams and allows slitting through the entire device to reduce costs of belt fabrication.

It is still another object of this invention to provide a thin, flexible electrophotographic imaging member containing charge generation layers which are readily coatable.

It is another object of this invention to provide a thin, flexible electrophotographic imaging member exhibiting improved adhesion between a charge generation layer and other layers.

The foregoing objects and others are accomplished in accordance with this invention by providing a flexible electrophotographic imaging member comprising a supporting substrate having an electrically conductive surface, a charge generation layer and a charge transport layer, the charge generation layer comprising a homogeneous dispersion of photoconductive particles of trigonal selenium dispersed in a film forming polymer blend of polycarbonate, polyvinylchloride-polyvinylacetate copolymer and a polymer selected from the group consisting of phenoxy resin, styrene butadiene copolymer and mixtures thereof. This imaging member may be used in an electrophotographic imaging process.

The supporting substrate layer having an electrically conductive surface may comprise any suitable flexible web or sheet material. The electrically conductive surface may be opaque or substantially transparent and may comprise numerous suitable materials having the required mechanical properties. For example, the electrically conductive surface may comprise an underlying flexible insulating support layer coated with a flexible electrically conductive layer, or merely a flexible conductive layer having sufficient internal strength to support the electrophotoconductive layer and anti-curl layer. The flexible electrically conductive layer, which may comprise the entire supporting substrate or merely be present as a coating on an underlying flexible web member, may comprise any suitable electrically conductive material including, for example, aluminum, titanium, nickel, chromium, brass, gold, stainless steel, carbon black, graphite and the like. The flexible conductive layer may vary in thickness over substantially wide ranges depending on the desired use of the electrophotoconductive member. Accordingly, the conductive layer can generally range in thicknesses of from about 50 Angstrom units to many centimeters. When a highly flexible photoresponsive imaging device is desired, the thickness of the conductive layer may be between about 100 Angstrom units to about 750 Angstrom units. Any suitable underlying flexible support layer may be utilized such as a thermoplastic film forming polymer alone or a thermoplastic film forming polymer in combination with other materials such as conductive particles of metal, carbon black and the like. Typical underlying flexible support layers comprising film forming polymers include insulating non-conducting materials comprising various resins such as polyethersulfone resins, polycarbonate resins, polyvinyl fluoride resins, polystyrene resins and the like. Preferred substrates are polyethersulfone (Stabar S-100, available from from ICI), polyvinyl fluoride (Tedlar, available from E. I. duPont de Nemours & Company), biaxially oriented polyethylene terephthalate (Melinex, available from ICI) and amorphous polyethylene terephthalate (Melinar, available from ICI Americas, Inc.) and the like. The coated or uncoated flexible supporting substrate layer is highly flexible and may have any number of different configurations such as, for example, a sheet, a scroll, an endless flexible belt, and the like.

If desired, any suitable charge blocking layer may be interposed between the conductive layer and the electrophotographic imaging layer. Some materials can form a layer which functions as both an adhesive layer and charge blocking layer. Typical blocking layers include polyvinylbutyral, organosilanes, epoxy resins, polyesters, polyamides, polyurethanes, silicones and the like. The polyvinylbutyral, epoxy resins, polyesters, polyamides, and polyurethanes can also serve as an adhesive layer. Adhesive and charge blocking layers preferably have a dry thickness between about 20 Angstroms and about 2,000 Angstroms.

The silane reaction product described in U.S. Pat. No. 4,464,450 is particularly preferred as a blocking layer material because cyclic stability is extended. The entire disclosure of U.S. Pat. No. 4,464,450 is incorporated herein by reference. These silanes have the following structural formula:

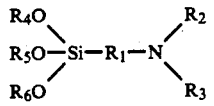

wherein $R_1$ is an alkylidene group containing 1 to 20 carbon atoms, $R_2$ and $R_3$ are independently selected from the group consisting of H, a lower alkyl group containing 1 to 3 carbon atoms, a phenyl group and a poly(ethyleneamino) group, and $R_4$, $R_5$, and $R_6$ are independently selected from a lower alkyl group containing 1 to 4 carbon atoms. Typical hydrolyzable silanes include 3-aminopropyltriethoxysilane, N-aminoethyl-3-aminopropyltrimethoxysilane, N-2-aminoethyl-3-aminopropyltrimethoxysilane, N-2-aminoethyl-3-aminopropyltris(ethylethoxy) silane, p-aminophenyl trimethoxysilane, 3-aminopropyldiethylmethylsilane, (N,N'-dimethyl 3-amino)propyltriethoxysilane, 3-aminopropylmethyldiethoxysilane, 3-aminopropyl trimethoxysilane, N-methylaminopropyltriethoxysilane, methyl[2-(3-trimethoxysilylpropylamino)ethylamino]-3-proprionate, (N,N'-dimethyl 3-amino)propyl triethoxysilane, N,N-dimethylaminophenyltriethoxy silane, trimethoxysilylpropyldiethylenetriamine and mixtures thereof. The blocking layer forming hydrolyzed silane solution may be prepared by adding sufficient water to hydrolyze the alkoxy groups attached to the silicon atom to form a solution. Generally, dilute solutions are preferred for achieving thin coatings. Satisfactory reaction product layers may be achieved with solutions containing from about 0.1 percent by weight to about 1 percent by weight of the silane based on the total weight of solution. A solution containing from about 0.01 percent by weight to about 2.5 percent by weight silane based on the total weight of solution are preferred for stable solutions which form uniform reaction product layers.

Any suitable technique may be utilized to apply the hydrolyzed silane solution to the metal oxide layer of a metallic conductive anode layer. Typical application techniques include spraying, dip coating, roll coating, wire wound rod coating, and the like. Generally, satisfactory results may be achieved when the reaction product of the hydrolyzed silane and metal oxide layer forms a layer having a thickness between about 20 Angstroms and about 2,000 Angstroms.

In some cases, optional intermediate layer between the blocking layer and the adjacent charge generating or photogenerating material may be added. If such layers are utilized, they preferably have a dry thickness between about 0.01 micrometer to about 5 micrometers. Typical intermediate layers include film-forming polymers such as polyester, polyvinylbutyral, polyvinylpyrolidone, polyurethane, polymethyl methacrylate and the like.

Generally, the electrophotoconductive imaging member of this invention comprises a supporting substrate having an electrically conductive surface, an optional charge blocking layer, an optional intermediate layer, a charge generation layer and a charge transport layer, the charge generation layer comprising a homogeneous dispersion of photoconductive particles of trigonal selenium dispersed in a blend of polycarbonate, polyvinylchloride-polyvinylacetate-polyvinylalcohol terpolymer and a polymer selected from the group consisting of phenoxy resin, styrene butadiene copolymer and mixtures thereof.

The charge generating or photogenerating particle employed in the charge generation layer of this invention is trigonal selenium. Generally, the trigonal selenium particles have an average particle size of between about 0.3 micrometer and about 1 micrometer. An average particle size of less than about 0.6 micrometer is preferred for greater coating uniformity and to optimize xerographic performance.

The film forming binder for the photoconductive trigonal selenium particles in the charge generating layer of this invention comprises a blend of polycarbonate, polyvinylchloride-polyvinylacetate copolymer and a polymer selected from the group consisting of phenoxy resin, styrene butadiene copolymer and mixtures thereof. Satisfactory results may be achieved when the polyvinylchloride-polyvinylacetate copolymer comprises between about 70 percent and about 98 percent by weight polyvinylchloride, between about 29 percent and about 1 percent by weight polyvinylacetate, and up to about 29 percent by weight polyvinylalcohol. Preferably, the polyvinylchloride-polyvinylacetate copolymer is a terpolymer comprising between about 85 percent and about 95 percent by weight polyvinylchloride, between about 15 percent and about 2 percent by weight polyvinylacetate, and between about 11 percent and about 2 percent by weight polyvinylalcohol. Optimum results are achieved when the polyvinylchloride-polyvinylacetate copolymer is a terpolymer comprising between about 90 percent and about 92 percent by weight polyvinylchloride, between about 2 percent and about 5 percent by weight polyvinylacetate, and between about 5 percent and about 7 percent by weight polyvinylalcohol. Generally, polyvinylchloride-polyvinylacetate copolymers outside the foregoing ranges are more likely to phase separate. A satisfactory weight average molecular weight range for the polyvinylchloride-polyvinylacetate copolymer is between about 20,000 and about 50,000. A molecular weight less than about 20,000 can result in mechanically weaker films which can crack or shatter upon flexing. A molecular weight exceeding about 50,000 can lead to degraded dispersion quality. The photoconductive trigonal selenium particles should form a homogeneous dispersion in the film forming charge generating layer binder of this invention. The expression "homogeneous dispersion" as employed herein is defined as a dispersion in which any distinct phase has an average diameter of less than about 50 micrometers. Distinct phases having an average diameter of greater than about 50 micrometers tend to cause the formation of objectionable background deposits in final electrophotographic prints.

Any suitable film forming polycarbonate binder soluble in nonchlorinated solvents may be utilized with the terpolymer and phenoxy or styrene butadiene copolymer to form the film forming binder matrix of the charge generating layer of this invention. Chlorinating solvents are undesirable because they tend to inhibit uniform dispersion of trigonal selenium particles in the binder and may affect electrical performance. Typical polycarbonates soluble in nonchlorinated solvents include, for example, the polycarbonates having the following formulae:

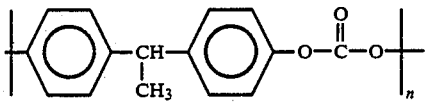

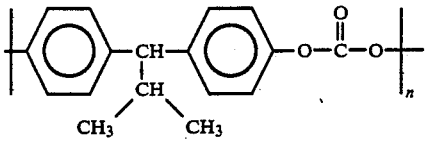

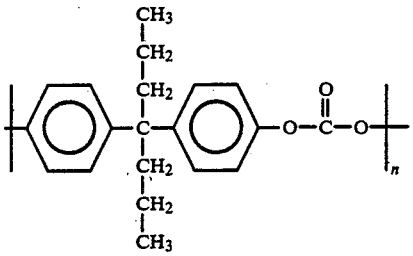

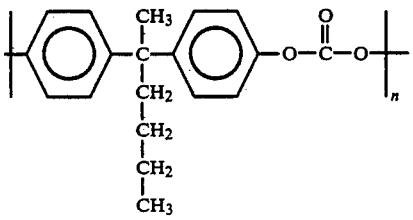

-continued

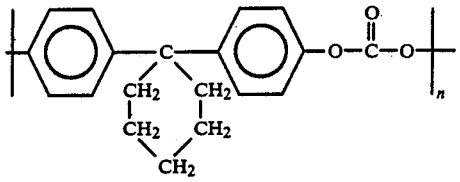

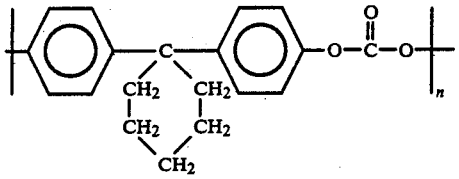

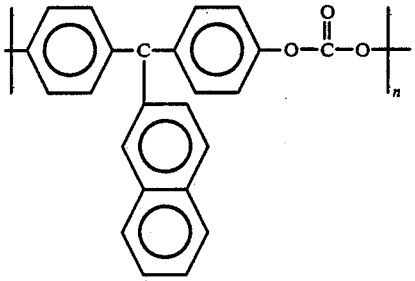

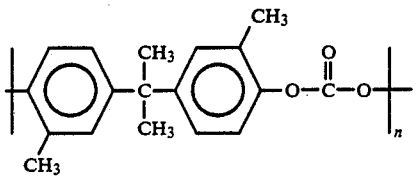

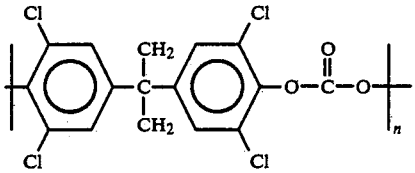

wherein n is a number sufficient to achieve a molecular weight of at least about 30,000. A satisfactory molecular weight polycarbonate is one that is at least about 30,000. A molecular weight less than about 30,000 can result in mechanically weaker films. For example, excellent results were achieved with poly[1,1-cyclohexanebis(4-phenyl)carbonate] having a molecular weight of about 70,000. There does not appear to be an upper limit to the molecular weight other than that which might lead to high viscosities that hinder removal from reaction vessels during synthesis.

Any suitable film forming phenoxy resin binder may be utilized with the polyvinylchloride-polyvinylacetate copolymer and polycarbonate to form the film forming binder matrix of the charge generating layer of this invention. A phenoxy resin [poly(hydroxyether] may have the following formula:

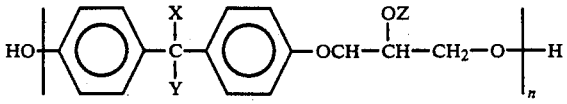

wherein X and Y are independently selected from the group consisting of aliphatic groups and aromatic groups, Z is hydrogen, an aliphatic group, an aromatic group, a carbonyl group, a carboxyl group, a carbonate group and the like, and n is a number sufficient to achieve a molecular weight of at least about 30,000. Examples of aliphatic groups for the phenoxy, include those containing from about 1 carbon atom to about 30 carbon atoms, such as methyl, ethyl, propyl, butyl, pentyl, hexyl, heptyl, decyl, pentadecyl, eicodecyl, and the like. Preferred aliphatic groups including alkyl groups containing from about 1 carbon atom to about 6 carbon atoms, such as methyl, ethyl, propyl, butyl. Illustrative examples of aromatic groups include those containing from about 6 carbon atoms to about 25 carbon atoms, such as phenyl, napthyl, anthryl and the like, with phenyl being preferred. Encompassed within these aliphatic and aromatic groups are aliphatic and aromatic groups which can be substituted with various known substituents, including, for example, alkyl, halogen, nitro, sulfo, and the like. Examples of the Z substituent include hydrogen, as well as aliphatic, aromatic, substituted aliphatic, and substituted aromatic groups as defined herein. Furthermore, Z can be selected from carboxyl, carbonyl, carbonate, and other similar groups, resulting in for example, the corresponding esters, and carbonates of the phenoxy. The phenoxy includes these wherein X and Y are alkyl groups, such as methyl, Z is hydrogen or a carbonate group, and n is a number ranging from about 75 to about 100. Specific examples of phenoxy resins include those commercially available from Union Carbide Corporation and resulting from the reaction of 2,2-bis(4-hydroxyphenylpropane). Specific phenoxy resins include, for example, phenoxy end capped poly(2,2-bis(4-glycidylphenyl)propane) (Phenoxy PKHH, available from Union Carbide Co.), Phenoxy PKHJ also available from Union Carbide Co. and the like. A satisfactory molecular weight is one that is at least about 30,000. A molecular weight less than about 30,000 can result in mechanically weaker films. As with the polycarbonate binder, there does not appear to be an upper limit to the molecular weight other than that which might lead to high viscosities that hinder removal from reaction vessels during synthesis. Phenoxy resins [poly(hydroxyether)] are well known and described, for example in U.S. Pat. No. 4,439,507, the entire disclosure thereof being incorporated herein by reference.

Any suitable film forming styrene butadiene copolymer binder may be utilized with the terpolymer and polycarbonate to form the film forming binder matrix of the charge generating layer of this invention. Satisfactory results may be achieved when the copolymer comprises between about 35 percent and about 60 percent by weight styrene and between about 65 percent and about 40 percent by weight butadiene. Optimum results are achieved when the copolymer comprises between about 40 percent and about 44 percent by weight styrene between about 60 percent and about 56 percent by weight butadiene. A satisfactory molecular weight for the copolymer is one that is at least about 30,000. A molecular weight less than about 30,000 can result in mechanically weak films. As with the polycarbonate binder and phenoxy resin, there does not appear to be an upper limit to the molecular weight other than that which might lead to high viscosities that hinder removal from reaction vessels during synthesis.

If desired, instead of adding either the phenoxy resin or styrene butadiene copolymer to the charge generating binder mixture, a combination of both the phenoxy resin and styrene butadiene copolymer may be incorporated into the charge generating binder mixture. If such combination is utilized, the proportion of the combination utilized relative to the remaining binder components should be the same as when only one of the two is used.

The blend of binder components in the charge generating layer preferably comprises between about 65 percent and about 75 percent by weight polycarbonate, between and about 15 percent by weight and 25 by weight polyvinylchloride-polyvinylacetate copolymer, and between about 15 percent and about 5 percent by weight of a polymer selected from the group consisting of phenoxy resin, styrene butadiene copolymer and mixtures thereof. Blends outside these component ranges tend to form layers containing undesirably large distinct phases which promote the formation of objectionable background deposits in final electrophotographic prints.

Any suitable nonchlorinated solvent may be utilized to dissolve the film forming binder matrix material to form a dispersion for application as a coating along with the uniformly dispersed photoconductive particles. Typical solvents include tetrahydrofuran, toluene, benzene, cyclohexane, and the like. These nonchlorinated solvents should preferably contribute to the wetting and dispersion of the photoconductive particles in the coating mixture during dispersion processing such as by milling. Typical milling techniques include, for example, ball milling, and attriting. The amount of solvent utilized depends upon the particular technique employed to apply the coating mixture to a substrate. For example, for spray application, the coating mixture may comprise between about 90 percent and about 97 percent by weight solvent based on the total weight of the coating mixture. For extrusion coating, a coating mixture might, for example, contain between about 80 percent by weight and about 95 percent by weight solvent based on the total weight of the coating mixture.

Generally, for dried generator layers containing a binder of this invention, between about 30 percent by weight to about 70 percent by weight of the photogenerating trigonal selenium pigment is dispersed in between about 70 percent and about 30 percent by weight of binder and more preferably between about 40 percent and about 60 percent by volume of the photogenerating pigment is dispersed in between about 60 percent and about 40 percent by weight of the binder. The specific proportions selected also depends to some extent on the thickness of the generator layer desired. The thickness of the photogenerating binder layer is not particularly critical. Generator layer thicknesses between about 0.1 micrometer to about 5 micrometers have been found to be satisfactory.

The charge transport layer should also be capable of supporting the injection of photo-generated holes and electrons from the charge transport layer and allowing the transport of these holes or electrons through the charge transport layer to selectively discharge the surface charge. The active charge transport layer not only serves to transport holes or electrons, but also protects the photoconductive layer from abrasion or chemical attack and therefor extends the operating life of the photoreceptor imaging member. The charge transport layer should exhibit negligible, if any, discharge when exposed to a wavelength of light useful in xerography, e.g. 4000 Angstroms to 8000 Angstroms. Therefore, the charge transport layer is preferably transparent to radiation in a region in which the photoconductor is to be used. Thus, the active charge transport layer is a substantially non-photoconductive material which supports the injection of photogenerated holes from the generation layer. The active transport layer is normally transparent when exposure is is effected through the active layer to ensure that most of the incident radiation is utilized by the underlying charge carrier generator layer for efficient photogeneration. When used with a transparent substrate, imagewise exposure may be accomplished through the substrate with all light passing through the substrate. In this case, the active transport material need not be absorbing in the wavelength region of use. The charge transport layer in conjunction with the generation layer in the instant invention is a material which is an insulator to the extent that an electrostatic charge placed on the transport layer is not conductive in the absence of illumination, i.e. a rate sufficient to prevent the formation and retention of an electrostatic latent image thereon. The active charge transport layer may comprise a hole transporting polymer or an activating compound dispersed in electrically inactive polymeric material.

Polymers having the capability of transporting holes contain repeating units of a polynuclear aromatic hydrocarbon which may also contain heteroatoms such as for example, nitrogen, oxygen or sulfur. Typical polymers include poly-N-vinylcarbazole; poly-1-vinylpyrene; poly-9-vinylanthracene; polyacenaphthalene; poly-9-(4-pentenyl)-carbazole; poly-9-(5-hexyl)-carbazole; polymethylene pyrene; poly-1-(pyrenyl)-butadiene; N-substituted polymeric acrylic acid amides of pyrene; the polymeric reaction product of N,N'-diphenyl N,N'bis (3-hydroxy phenyl)-[1,1'biphenyl]-4,4'diamine and diethylene glycol bischloroformate, and the like.

The active charge transport layer may comprise an activating compound useful as an additive dispersed in electrically inactive polymeric materials making these materials electrically active. These compounds may be added to polymeric materials which are incapable of supporting the injection of photogenerated holes from the generation material and incapable of allowing the transport of these holes therethrough. This will convert the electrically inactive polymeric material to a material capable of supporting the injection of photogenerated holes from the generation material and capable of allowing the transport of these holes through the active layer in order to discharge the surface charge on the active layer.

Preferred electrically active layers comprise an electrically inactive resin material, e.g. a polycarbonate, polystyrene or polyether carbonate made electrically active by the addition of one or more of the following compounds poly-N-vinylcarbazole; poly-1-vinylpyrene; poly-9-vinylanthracene; polyacenaphthalene; poly-9-(4-pentenyl)-carbazole; poly-9-(5-hexyl)-carbazole; polymethylene pyrene; poly-1-(pyrenyl)-butadiene; N-substituted polymeric acrylic acid amides of pyrene; N,N'-diphenyl-N,N'-bis(phenylmethyl)-[1,1'-biphenyl]-4,4'-diamine; N,N'-diphenyl-N,N'-bis(3-methylphenyl)-2,2'-dimethyl-1,1'-biphenyl-4,4'-diamine and the like.

An especially preferred transport layer employed in one of the two electrically operative layers in the multilayer photoconductor of this invention comprises from about 25 to about 75 percent by weight of at least one charge transporting aromatic amine compound and about 75 to about 25 percent by weight of a polymeric film forming resin in which the aromatic amine is soluble.

The charge transport layer forming mixture preferably comprises an aromatic amine compound of one or more compounds having the general formula:

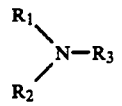

wherein $R_1$ and $R_2$ are an aromatic group selected from the group consisting of a substituted or unsubstituted phenyl group, naphthyl group, and polyphenyl group and $R_3$ is selected from the group consisting of a substituted or unsubstituted aryl group, alkyl group having from 1 to 18 carbon atoms and cycloaliphatic compounds having from 3 to 18 carbon atoms. The substituents should be free from electron withdrawing groups such as $NO_2$ groups, CN groups, and the like. Typical aromatic amine compounds that are represented by this structural formula include:

I. Triphenyl amines such as:

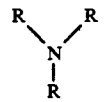

II. Bis and poly triarylamines such as:

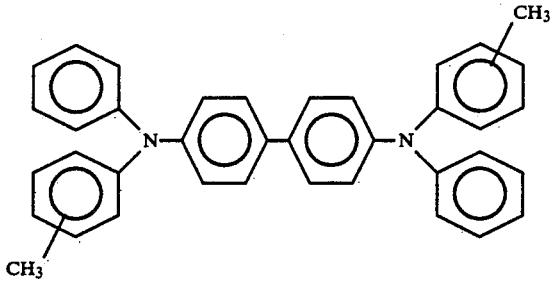

III. Bis arylamine ethers such as:

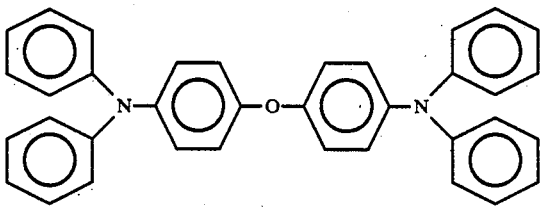

IV. Bis alkyl-arylamines such as:

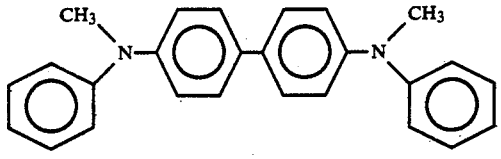

A preferred aromatic amine compound has the general formula:

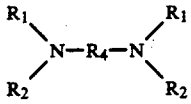

wherein $R_1$, and $R_2$ are defined above and $R_4$ is selected from the group consisting of a substituted or unsubstituted biphenyl group, diphenyl ether group, alkyl group having from 1 to 18 carbon atoms, and cycloaliphatic group having from 3 to 12 carbon atoms.

Excellent results in controlling dark decay and background voltage effects have been achieved when the imaging members comprising a charge generation layer comprise a layer of photoconductive material and a contiguous charge transport layer of a polycarbonate resin material having a molecular weight of from about 20,000 to about 120,000 having dispersed therein from about 25 to about 75 percent by weight of one or more diamine compounds having the general formula:

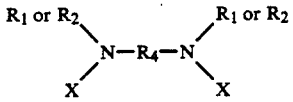

wherein $R_1$, $R_2$, and $R_4$ are defined above and X is selected from the group consisting of an alkyl group having from 1 to about 4 carbon atoms and chlorine, the photoconductive layer exhibiting the capability of photogeneration of holes and injection of the holes and the charge transport layer being substantially non-absorbing in the spectral region at which the photoconductive layer generates and injects photogenerated holes but being capable of supporting the injection of photogenerated holes from the photoconductive layer and transporting the holes through the charge transport layer.

Example of charge transporting aromatic amines represented by the structural formulae above for charge transport layers capable of supporting the injection of photogenerated holes of a charge generating layer and transporting the holes through the charge transport layer include triphenylmethane, bis(4-diethylamine-2-methylphenyl)phenylmethane; 4'-4''-bis(diethylamino)-2',2''-dimethyltriphenyl-methane, N,N'-bis(alkylphenyl)-[1,1'-biphenyl]-4,4'-diamine wherein the alkyl is, for example, methyl, ethyl, propyl, n-butyl, etc., N,N'-diphenyl-N,N'-bis(chlorophenyl)-[1,1'-biphenyl]-4,4'-diamine, N,N'-diphenyl-N,N'-bis(3''-methylphenyl)-(1,1'-biphenyl)-4,4'-diamine, and the like dispersed in an inactive resin binder.

Any suitable inactive resin binder soluble in a suitable solvent may be employed in the process of this invention. Typical inactive resin binders soluble in solvents include polycarbonate resins such as poly(4,4'-isopropylidenediphenyl carbonate) and poly[1,1-cyclohexanebis(4-phenyl)carbonate], polystyrene resins, polyether carbonate resins, 4,4'-cyclohexilidene diphenyl polycarbonate, polyarylate, and the like. Molecular weights can vary from about 20,000 to about 1,500,000.

The preferred electrically inactive resin materials are polycarbonate resins have a molecular weight from about 20,000 to about 100,000, more preferably from about 50,000 to about 100,000. The materials most preferred as the electrically inactive resin material are poly[1,1-cyclohexanebis(4-phenyl)carbonate] with a molecular weight of from about 50000 to about 100,000, poly(4,4'-dipropylidene-diphenylene carbonate) with a molecular weight of from about 35,000 to about 40,000 (available as Lexan 145 from General Electric Company); poly(4,4'-isopropylidene-diphenylene carbonate) with a molecular weight of from about 40,000 to about 45,000 (available as Lexan 141 from the General Electric Company); a polycarbonate resin having a molecular weight of from about 50,000 to about 100,000 (available as Makrolon from Farbenfabricken Bayer A. G.) and a polycarbonate resin having a molecular weight of from about 20,000 to about 50,000 (available as Merlon from Mobay Chemical Company). Any suitable solvent such as methylene chloride may be used as a component of the charge transport layer coating mixture. The solvent preferably dissolves all of the coating composition components and has a low boiling point.

In all of the above charge transport layers, the activating compound which renders the electrically inactive polymeric material electrically active should be present in amounts of from about 15 to about 75 percent by weight based on the total weight of the layer.

Any suitable and conventional technique may be utilized to mix and thereafter apply the charge transport layer coating mixture to the charge generating layer. Typical application techniques include spraying, dip coating, roll coating, wire wound rod coating, and the like. Drying of the deposited coating may be effected by any suitable conventional technique such as oven drying, infra red radiation drying, air drying and the like. Generally, the thickness of the transport layer is between about 5 micrometers to about 100 micrometers, but thicknesses outside this range can also be used.

The charge transport layer should be an insulator to the extent that the electrostatic charge placed on the charge transport layer is not conducted in the absence of illumination at a rate sufficient to prevent formation and retention of an electrostatic latent image thereon. In general, the ratio of the thickness of the charge transport layer to the charge generator layer is preferably maintained from about 2:1 to 200:1 and in some instances as great as 400:1.

Although the location of the charge generating layer has been described above as between a charge transport layer and a conductive surface, the relative locations of the charge generating layer and charge transport layer may be reversed, if desired.

Optionally, a thin overcoat layer may also be utilized to improve resistance to abrasion. These overcoating layers may comprise organic polymers or inorganic polymers that are electrically insulating or slightly semi-conductive.

A number of examples are set forth hereinbelow and are illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

EXAMPLE I

A polyester film was vacuum coated with a titanium layer having a thickness of about 200 Angstroms. The exposed surface of the titanium layer was oxidized by exposure to oxygen in the ambient atmosphere. A siloxane hole blocking layer was prepared by applying a 0.22 percent (0.001 mole) solution of 3-aminopropyl triethoxylsilane to the oxidized surface of the titanium layer with a gravure applicator. The deposited coating was dried at 135° C. in a forced air oven to form a layer having a thickness of about 450 Angstroms. An intermediate layer coating of polyester resin (49000, available from E. I. duPont de Nemours & Co.) was applied with a gravure applicator to the siloxane coated base. The polyester resin coating was dried to form a film having a thickness of about 0.05 micrometer. A slurry coating solution of 50 percent by weight sodium doped trigonal selenium having a particle size of about 0.05 micrometer to 0.2 micrometer and about 50 percent by weight of a polymer blend of poly[1,1-cyclohexanebis(4-phenyl)-carbonate], polyvinylchloride-polyvinylacetate-polyvinylalcohol terpolymer, and phenoxy resin in a 50:50 by weight mixture of tetrahydrofuran and toluene was coated with a Bird Bar applicator onto the polyester coating to form a layer having a wet thickness of 2.5 micrometers. The weight ratio of the polymers in the blend was 70:20:10. The weight ratio of the components of the terpolymer was 91:3:6 for polyvinylchloride, polyvinylacetate, and polyvinylalcohol, respectively. The number average molecular weights of the polymers in the blend were about 70,000 for poly[1,1-cyclohexanebis(4-phenyl)carbonate], about 24,500 for the terpolymer, and about 55,000 for the phenoxy resin. The coated member was dried at 135° C. in a forced air oven to form a charge generation layer having a dry thickness of about 2.0 micrometers. The trigonal selenium particles were homogeneously dispersed in the polymer blend of the dried charge generation layer. A charge transport layer was formed on the charge generator layer by applying a solution of a polycarbonate resin having a molecular weight from about 50,000 to about 100,000 (Makrolon, available from Farbenfabriken Bayer A. G.) and N,N'-diphenyl-N,N'-bis(3-methylphenyl)-[1,1'-biphenyl]-4,4'-diamine dissolved in methylene chloride to ultimately provide a 50 percent by weight loading of N,N'-diphenyl-N,N'-bis(3-methylphenyl)-[1,1'-biphenyl]-4,4'-diamine in the dried transport layer. The transport layer was coated on top of the generator layer with a Bird Bar applicator and dried at temperature of about 135° C. to form a 24 micrometer thick dry layer of hole transporting material. The photoreceptor was xerographically cycled at 20° C. at 40 percent RH. Cycling was conducted in a xerographic scanner testing device comprising a cylindrical aluminum drum having a diameter of about 9.5 inches and having a corotron, erase lamp and a probe mounted around the periphery of the drum. The photoreceptor sample was taped to the drum. The drum was driven at a constant surface speed of 30 inches per second. The photoreceptor was rested in the dark overnight prior to charging. The photoreceptor was then negatively corona charged in the dark to a development potential of about - 800 volts. The charging current to the photoreceptor sample corotron was controlled by a Trek Coratrol Model 610B Power Supply. The photoreceptors samples were thereafter exposed to photodischarge levels ranging from 0 to 25 and finally erased by exposure to about 500 erg/cm$^2$ prior to the following charge cycle, and then subjected to the equivalent life of 10,000 imaging cycles. The surface potential $E_o$ was measured and plotted in terms of field strength and cycles. The measurements were made with an electrostatic probe, adjacent to the photoreceptor and corotron, 0.7 seconds after charging. The probe was connected to a TREK Electrostatic Voltmeter Model 4600, the output of which was transmitted to a Graphic Recorder Model WR3101. The charge, photodischarge and erase properties over the equivalent life to 10,000 imaging cycles were comparable to that obtained on a Xerox 1090 photoreceptor.

EXAMPLE II

A polyester film was vacuum coated with a titanium layer having a thickness of about 200 Angstroms. The exposed surface of the titanium layer was oxidized by exposure to oxygen in the ambient atmosphere. A siloxane hole blocking layer was prepared by applying a 0.22 percent (0.001 mole) solution of 3-aminopropyl triethoxylsilane to the oxidized surface of the aluminum layer with a gravure applicator. The deposited coating was dried at 135° C. in a forced air oven to form a layer having a thickness of 450 Angstroms. An intermediate layer coating of polyester resin, (49000, available from E. I. duPont de Nemours & Co.) was applied with a gravure applicator to the siloxane coated base. The polyester resin coating was dried to form a film having a thickness of about 0.05 micrometer. A slurry coating solution of 50 percent by weight sodium doped trigonal selenium having a particle size of about 0.05 micrometer to 0.2 micrometer and about 50 percent by weight of a polymer blend of poly[1,1-cyclohexanebis(4-phenyl)-carbonate], polyvinylchloride-polyvinylacetate-polyvinylalcohol terpolymer, and styrene butadiene copolymer in a 50:50 by weight mixture of tetrahydrofuran and toluene was coated with a Bird Bar applicator onto the polyester coating to form a layer having a wet thickness of 2.5 micrometers. The weight ratio of the polymers in the blend was 70:20:10. The weight ratio of the components of the terpolymer was 91:3:6 for polyvinylchloride, polyvinylacetate, and polyvinylalcohol, respectively. The weight ratio of styrene to butadiene was 43:57. The number average molecular weights of the polymers in the blend were about 70,000 for poly[1,1-cyclohexanebis(4-phenyl)carbonate], about 24,500 for the terpolymer, and about 94,000 for the styrene butadiene copolymer. The coated member was dried at 135° C. in a forced air oven to form a charge generation layer having a thickness of 2.0 micrometers. The trigonal selenium particles were homogeneously dispersed in the polymer blend of the dried charge generation layer. A charge transport layer was formed on the charge generator layer by applying a solution of a polycarbonate resin having a molecular weight from about 50,000 to about 100,000 (Makrolon, available from Farbenfabriken Bayer A. G.) and N,N'-diphenyl-N,N'-bis(3-methylphenyl)-[1,1'-biphenyl]-4,4'-diamine dissolved in methylene chloride to ultimately provide a 50 percent by weight loading of N,N'-diphenyl-N,N'-bis(3-methylphenyl)-[1,1'-biphenyl]-4,4'-diamine in the dried transport layer. The transport layer was coated on top of the generator layer with a Bird Bar applicator and dried at temperature of about 135° C. to form a 24 micrometer thick dry layer of hole transporting material. The photoreceptor was xerographically cycled at 20° C. at 40 percent RH in the same manner as described in Example I. The charge, photodischarge and erase properties over the equivalent life to 10,000 imaging cycles were comparable to that obtained on a Xerox 1090 photoreceptor.

EXAMPLE III

A polyester film was vacuum coated with a titanium layer having a thickness of about 200 Angstroms. The exposed surface of the titanium layer was oxidized by exposure to oxygen in the ambient atmosphere. A siloxane hole blocking layer was prepared by applying a 0.22 percent (0.001 mole) solution of 3-aminopropyl triethoxylsilane to the oxidized surface of the aluminum layer with a gravure applicator. The deposited coating was dried at 135° C. in a forced air oven to form a layer having a thickness of 450 Angstroms. An intermediate layer coating of polyester resin, (49000, available from E. I. duPont de Nemours & Co.) from was applied with a gravure applicator to the siloxane coated base. The polyester resin coating was dried to form a film having a thickness of about 0.05 micrometer. A slurry coating solution of 50 percent by weight sodium doped trigonal selenium having a particle size of about 0.05 micrometer to 0.2 micrometer and about 50 percent by weight of a polymer blend of poly[1,1-cyclohexanebis(4-phenyl)-carbonate], polyvinylchloride-polyvinylacetate-polyvinylalcohol terpolymer, and phenoxy resin in a 50:50 by weight mixture of tetrahydrofuran and toluene was coated with a Bird Bar applicator onto the polyester coating to form a layer having a wet thickness of 1.9 micrometers. The weight ratio of the polymers in the blend was 50:25:25. The weight ratio of the components of the terpolymer was 91:3:6 for polyvinylchloride, polyvinylacetate, and polyvinylalcohol, respectively. The number average molecular weights of the polymers in the blend were about 70,000 for poly[1,1-cyclohexanebis(4-phenyl)carbonate], about 24,500 for the terpolymer, and about 55,000 for the phenoxy resin. The coated member was dried at 135° C. in a forced air oven to form a charge generation layer having a thickness of 2.0 micrometers. The trigonal selenium particles were homogeneously dispersed in the polymer blend of the dried charge generation layer. A charge transport layer was formed on the charge generator layer by applying a solution of a polycarbonate resin having a molecular weight from about 50,000 to about 100,000 (Makrolon, available from Farbenfabriken Bayer A. G.) and N,N'-diphenyl-N,N'-bis(3-methylphenyl)-[1,1'-biphenyl]-4,4'-diamine dissolved in methylene chloride to ultimately provide a 50 percent by weight loading of N,N'-diphenyl-N,N'-bis(3-methylphenyl)-[1,1'-biphenyl]-4,4'-diamine in the dried transport layer. The transport layer was coated on top of the generator layer with a Bird applicator and dried at temperature of about 135° C. to form a 24 micrometer thick dry layer of hole transporting material. The photoreceptor was xerographically cycled at 20° C. at 40 percent RH in the same manner as described in Example I. The charge, photodischarge and erase properties over the equivalent life of 10,000 imaging cycles were comparable to that obtained on a Xerox 1090 photoreceptor.

EXAMPLE IV

Attempts were made to test the adhesion of the layers in the samples described in Example I, II, and III. The adhesion test required partial delamination between the generator layer and the polyester intermediate layer to enable adhesion peel measurements with an Instron Mechanical Tester. The delamination is normally initiated by first cutting into the surface of the charge transport layer, charge generator layer, etc. down to the ground plane and bending the photoreceptor web at the cut portion layer to cause sufficient separation of the charge generator layer from the underlying layer so that the ends of each partially separated segment can be gripped by the jaws of the Instron Mechanical Tester for measurement of the adhesive force between the charge generator layer and the underlying layer. Whereas the generator layer and the intermediate layer of the Xerox 1090 photoreceptor could be delaminated to enable testing with the Instron Mechanical Tester, the adhesion of the generator layer to the intermediate layer was so great in the samples of Example I, II, and III that the layers could not even be partially delaminated to allow testing with the Instron Mechanical Tester. Thus, these samples from Examples I, II, and III exhibited superior mechanical integrity between the generator layer and the intermediate layer compared to the mechanical integrity between the generator layer and the intermediate layer of the Xerox 1090 photoreceptor.

EXAMPLE V

Additional samples were prepared as described in Examples I, II and III except that the polyester intermediate layer was omitted. The adhesion of the generator layer to the siloxane hole layer was so great in these additional samples that the layers could not even be partially delaminated to allow testing with the Instron Mechanical Tester. The adhesion of the generator layer to the siloxane hole blocking layer in these additional samples was even greater than the adhesion of the generator layer to the intermediate polyester layer in the samples of Example I, II, and III.

Although the invention has been described with reference to specific preferred embodiments, it is not intended to be limited thereto, rather those skilled in the art will recognize that variations and modifications may be made therein which are within the spirit of the invention and within the scope of the claims.

What is claimed is:

1. A flexible electrophotographic imaging member comprising a supporting substrate, a charge generation layer and a charge transport layer, said charge generation layer comprising a homogeneous dispersion of photoconductive particles of trigonal selenium dispersed in a film forming polymer blend comprising between about 65 percent and about 75 percent by weight polycarbonate having a molecular weight of at least about 30,000, between about 15 percent and 25 percent by weight polyvinylchloride-polyvinylacetate copolymer having a molecular weight of between about 20,000 and about 50,000, and between about 15 percent and about 5 percent by weight of a polymer selected from the group consisting of phenoxy resin having a molecular weight of at least about about 30,000, styrene butadiene copolymer having a molecular weight of at least about about 30,000 and mixtures thereof, said photoconductive particles of trigonal selenium being present in said charge generation layer in an amount sufficient to photogenerate and inject holes and electrons into said charge transport layer to selectively discharge a surface charge on said imaging member when exposed to activating radiation.

2. A flexible electrophotographic imaging member according to claim 1 wherein said charge generation layer comprises a homogeneous dispersion of between about 30 percent and about 70 percent by weight of said trigonal selenium dispersed in between about 70 percent and about 30 percent by weight of said film forming polymer blend.

3. A flexible electrophotographic imaging member according to claim 1 wherein said polyvinylchloride-polyvinylacetate copolymer is a terpolymer comprising between about 70 percent and about 98 percent by weight polyvinylchloride, between about 29 percent and about 1 percent by weight polyvinylacetate, and up to about 29 percent by weight polyvinylalcohol.

4. A flexible electrophotographic imaging member according to claim 1 wherein said polycarbonate is poly[1,1-cyclohexanebis(4-phenyl)carbonate].

5. A flexible electrophotographic imaging member according to claim 1 wherein said polycarbonate is soluble in a solvent free of chlorination.

6. A flexible electrophotographic imaging member according to claim 1 wherein said styrene butadiene copolymer comprises between about 35 percent and about 60 percent by weight styrene and between about 65 percent and about 40 percent by weight butadiene.

7. A flexible electrophotographic imaging member according to claim 1 wherein said photoconductive particles comprise trigonal selenium particles having an average particle size of between about 0.3 micrometer and about 1 micrometer.

8. A flexible electrophotographic imaging member according to claim 1 wherein a blocking layer is interposed between said substrate and said charge generation layer.

9. A flexible electrophotographic imaging member according to claim 1 wherein an intermediate layer is interposed between said substrate and said charge generation layer.

10. A flexible electrophotographic imaging member according to claim 1 wherein an electrically conductive layer, a charge blocking layer and an intermediate layer are interposed between said substrate and said charge generation layer.

11. A flexible electrophotographic imaging member according to claim 1 wherein said charge transport layer comprises an organic polymer and an aromatic amine compound having the general formula:

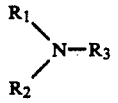

wherein $R_1$ and $R_2$ are an aromatic group selected from the group consisting of a substituted or unsubstituted phenyl group, naphthyl group, and polyphenyl group and $R_3$ is selected from the group consisting of a substituted or unsubstituted aryl group, alkyl group having from 1 to 18 carbon atoms and cycloaliphatic compounds having from 3 to 18 carbon atoms.

12. An electrophotographic imaging process comprising providing a flexible electrophotographic imaging member comprising a supporting substrate, a charge generation layer and a charge transport layer, said charge generation layer comprising a homogeneous dispersion of photoconductive particles of trigonal selenium dispersed in a film forming polymer blend comprising between about 65 percent and about 75 percent by weight polycarbonate having a molecular weight of at least about 30,000, between about 15 percent by weight and 25 by weight polyvinylchloride-polyvinylacetate copolymer having a molecular weight of between about 20,000 and about 50,000, and between about 15 percent and about 5 percent by weight of a polymer selected from the group consisting of phenoxy resin having a molecular weight of at least about 30,000, styrene butadiene copolymer having a molecular weight of at least about 30,000 and mixtures thereof, said photoconductive particles of trigonal selenium being present in said charge generation layer in an amount sufficient to photogenerate and inject holes and electrons into said charge transport layer to selectively discharge a surface charge on said imaging member when exposed to activating radiation, forming an electrostatic latent image on said imaging member, forming a toner image on said imaging member in conformance with said electrostatic latent image and transferring said toner image to a receiving member.

13. An electrophotographic imaging process according to claim 12 wherein said charge generation layer comprises a homogeneous dispersion of between about 30 percent by weight to about 70 percent by weight of said trigonal selenium dispersed in between about 70 percent and about 30 percent by weight of said film forming polymer blend.

14. An electrophotographic imaging process according to claim 12 wherein said copolymer is a terpolymer comprising between about 70 percent and about 98 percent by weight polyvinylchloride, between about 29 percent and about 1 percent by weight polyvinylacetate, and up to about about 29 percent by weight polyvinylalcohol.

15. An electrophotographic imaging process according to claim 12 wherein said polycarbonate is poly[1,1-cyclohexanebis(4-phenyl)carbonate].

16. An electrophotographic imaging process according to claim 12 wherein said styrene butadiene copolymer comprises between about 35 percent and about 60 percent by weight styrene and between about 65 percent and about 40 percent by weight butadiene.

17. An electrophotographic imaging process according to claim 12 wherein said photoconductive particles comprise trigonal selenium particles having an average particle size of between about 0.3 micrometer and about 1 micrometer.

18. An electrophotographic imaging process according to claim 12 wherein said forming of an electrostatic latent image on said imaging member, said forming of a toner image on said imaging member in conformance with an electrostatic latent image and said transferring of a toner image to a receiving member are repeated at least once.

* * * * *